US009246284B2

(12) United States Patent
Wu et al.

(10) Patent No.: US 9,246,284 B2
(45) Date of Patent: Jan. 26, 2016

(54) ELECTRICAL CONNECTOR WITH IMPROVED CONTACTS

(71) Applicant: FOXCONN INTERCONNECT TECHNOLOGY LIMITED, Grand Cayman, KY (US)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KW)

( * ) Notice: Subject to any disclaimer, the term of this patent is extended or adjusted under 35 U.S.C. 154(b) by 0 days.

(21) Appl. No.: 14/520,308

(22) Filed: Oct. 21, 2014

(65) Prior Publication Data

US 2015/0111427 A1 Apr. 23, 2015

(30) Foreign Application Priority Data

Oct. 21, 2013 (CN) ..... 2013 1 0494219

(51) Int. Cl.

| | |
|---|---|
| ***H01R 4/66*** | (2006.01) |
| ***H01R 24/62*** | (2011.01) |
| ***H01R 13/24*** | (2006.01) |
| ***H01R 13/6474*** | (2011.01) |
| *H01R 107/00* | (2006.01) |

(52) U.S. Cl.

CPC ..... *H01R 24/62* (2013.01); *H01R 13/2457* (2013.01); *H01R 13/6474* (2013.01); *H01R 2107/00* (2013.01)

(58) Field of Classification Search

CPC ..... H01R 23/7068; H01R 4/188

USPC ..... 439/59, 78, 82, 751, 882, 947, 79–80

See application file for complete search history.

(56) References Cited

U.S. PATENT DOCUMENTS

| | | | | |
|---|---|---|---|---|
| 3,230,493 | A * | 1/1966 | Jensen | H01R 12/727 439/79 |
| 4,684,203 | A * | 8/1987 | Bihler | H01R 12/585 29/876 |
| 4,906,209 | A * | 3/1990 | Tanabe | H01R 13/7197 439/620.24 |
| 5,452,512 | A * | 9/1995 | Foley | H01R 12/585 29/874 |
| 5,556,308 | A * | 9/1996 | Brown | H01R 12/58 439/746 |
| 6,953,351 | B2 | 10/2005 | Fromm et al. | |

(Continued)

FOREIGN PATENT DOCUMENTS

| | | |
|---|---|---|
| TW | M439294 | 10/2012 |

*Primary Examiner* — Phuongchi T Nguyen

(74) *Attorney, Agent, or Firm* — Wei Te Chung; Ming Chieh Chang

(57) ABSTRACT

An electrical connector includes a first insulative housing (21), a number of first contacts (22) retained in the first insulative housing, and a metallic shell shielding on the first insulative housing. Each first contact comprises a main portion, a contacting section (2211) in front of the base portion, and a soldering section (2201) behind the base portion. Each first contact has a first sub-contact (220) and a second sub-contact (221) stacked with each other. The first sub-contact (220) comprises a first main section (2202) and the soldering section, the second sub-contact (221) comprises a second main section (2210) and the contacting section, the first main section is superimposed on the second main section to form the main portion, and the main portion of the first contact has a larger thickness than the contacting section and the soldering section.

13 Claims, 10 Drawing Sheets

(56) References Cited

U.S. PATENT DOCUMENTS 7,088,200 B2 8/2006 Bartley et al.
7,591,655 B2 9/2009 Fedder et al.
8,382,524 B2 2/2013 Khilchenko et al.
8,692,128 B2 4/2014 Su et al.

* cited by examiner

ELECTRICAL CONNECTOR WITH IMPROVED CONTACTS

BACKGROUND OF THE INVENTION

1. Field of the Invention

The present invention relates to an electrical connector, and more particularly to an electrical connector having contacts for improved characteristic impedance.

2. Description of Related Art

At present, an electrical connector usually includes an insulative housing and a plurality of contacts received in the insulative housing, and each contact comprises a soldering portion soldered with a wire, a mating portion contacted with corresponding contact of a complementary connector, and a middle portion located between the soldering portion and the mating portion. The soldering portion, a mating portion, and the middle portion have a same thickness, thus when the mating portion contacts with a complementary contact, the total thickness of a mating section of the complementary contact and the mating portion is greater than the thickness of the middle portion. When the soldering portion is soldered with the wire, the total thickness of the soldering portion and the wire along an up-to-down direction is also larger than the thickness of the middle portion. Therefore, as the electrical connector is in a working state, mutation phenomenon of the characteristic impedance of the contact may be present, that is, the characteristic impedance of the soldering portion and the mating portion is smaller than the characteristic impedance of the middle portion. Due to the occurrence of the above situation, stability of signal transmission of the electric connector will be affected.

U.S. Pat. No. 7,088,200, issued to Bartley et al. on Aug. 8, 2006, discloses a method and structure to control common mode impedance in fan-out regions for printed circuit board applications. A differential pair transmission line includes a narrow signal trace portion in the fan-out region and a wider signal trace portion outside of the fan-out region. The narrow signal trace portion in the fan-out region has an increased thickness relative to the wider signal trace portion.

Hence, an electrical connector with improved contacts for characteristic impedance is desired.

BRIEF SUMMARY OF THE INVENTION

According to one aspect of the present invention, an electrical connector comprises a first insulative housing, a plurality of first contacts retained in the first insulative housing, and a metallic shell shielding on the first insulative housing. Each first contact comprises a main portion, a contacting section in front of the base portion and a soldering section behind the base portion. Each first contact has a first sub-contact and a second sub-contact stacked with each other, and the first sub-contact comprises a first main section and the soldering section, the second sub-contact comprises a second main section and the contacting section, the first main section is superimposed on the second main section to form the main portion, and the main portion of the first contact has a larger thickness than the contacting section and the soldering section.

According to another aspect of the present invention, an electrical connector assembly comprises:

an electrical connector connected with a cable and comprising a first insulative housing and a plurality of first contacts received in the first insulative housing, each first contact including a main portion, a contacting section in front of the main portion, and a soldering section behind the main portion, the cable including a plurality of inner conductors; and a complementary connector mating with the electrical connector and comprising a second insulative housing and a plurality of second contacts retained in the second insulative housing; wherein the main portion of each first contact is formed by two pieces stacked with each other, and the thickness of the main portion of one first contact is substantially same as a combined thickness of one inner conductor and a corresponding soldering section soldered with the one inner conductor and is same as a total thickness of the contacting section of one first contact and a corresponding mating section of the second contact in contact with the one first contact.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
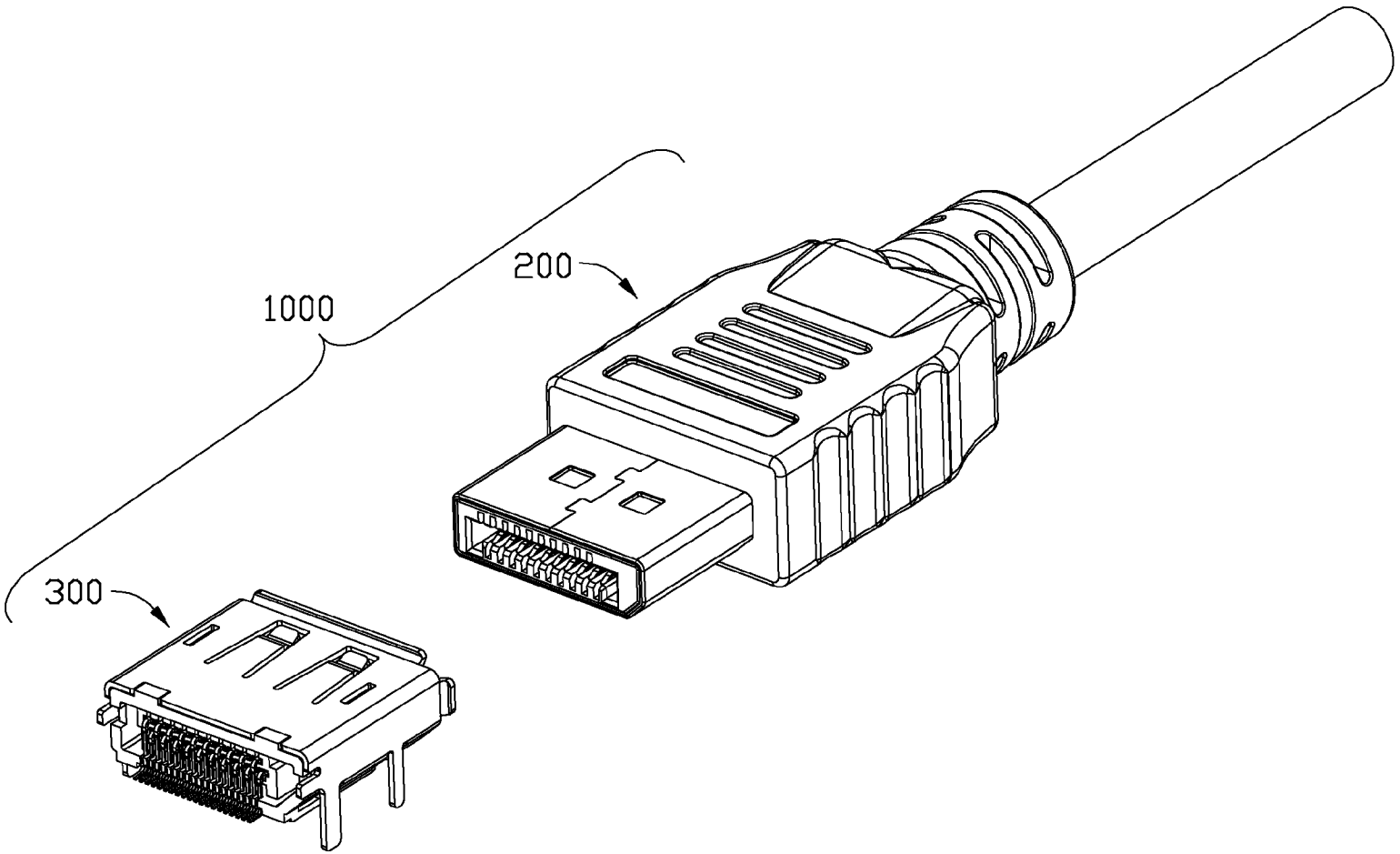
FIG. 1 is a perspective assembled view of an electrical connector according to the present invention before mating with a complementary connector.
Figure 2:
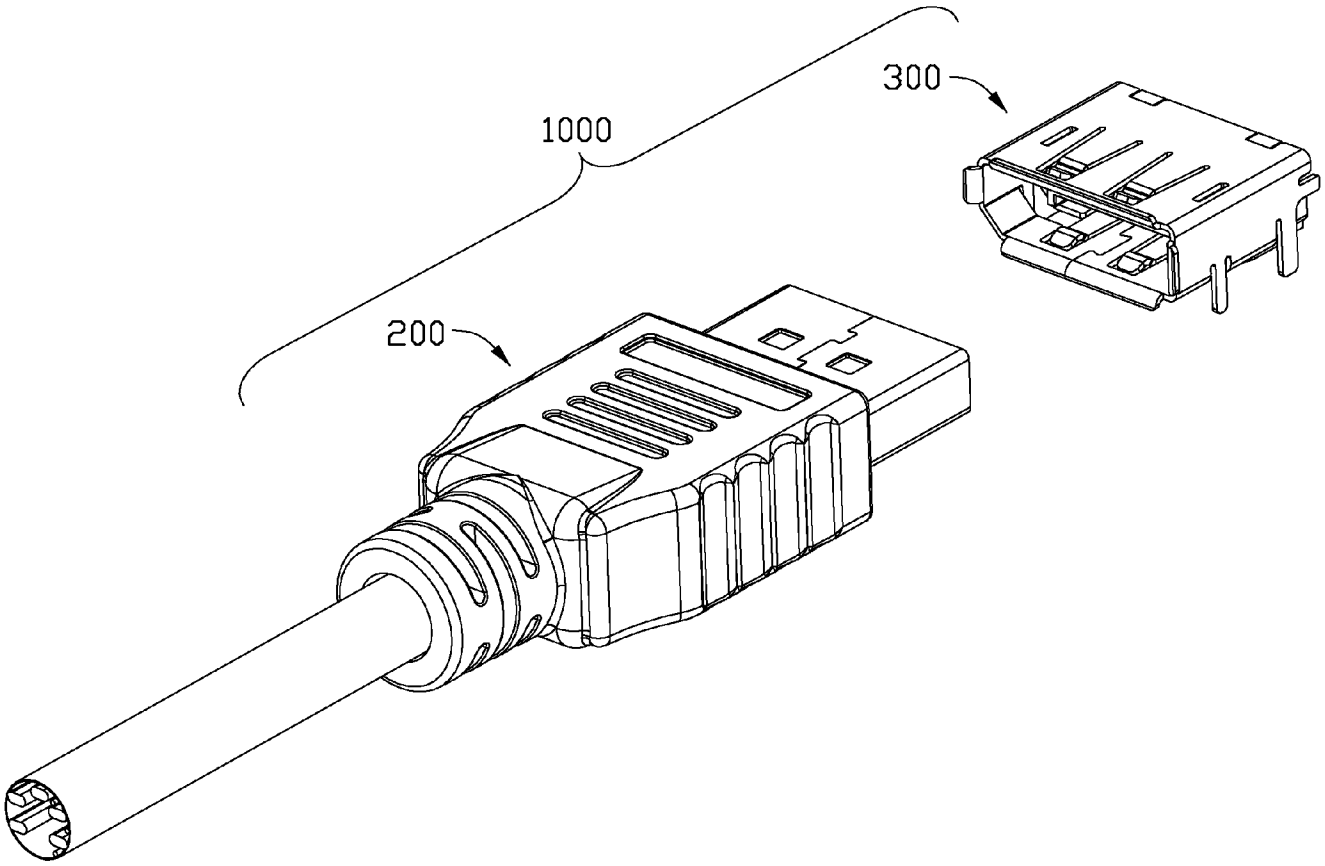
FIG. 2 is a view similar to FIG. 1, but viewed from another aspect.
Figure 9:
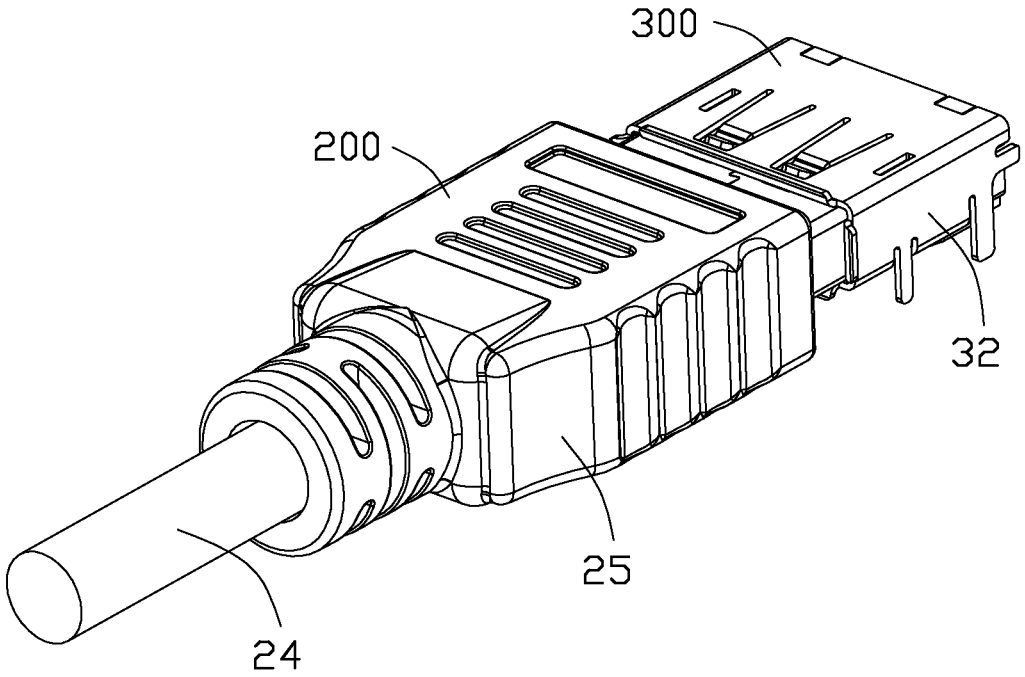
FIG. 9 is a perspective assembled view of the electrical connector mating with the complementary connector shown in FIG. 2.

Referring to FIGS. 1-2, and in conjunction with FIG. 9, an electrical connector assembly 1000 according to a preferred embodiment of the present invention includes an electrical connector 200 and a complementary connector 300 mating with the electrical connector 200. The electrical connector 200 is electrically connected with a cable 24.

Figure 3:
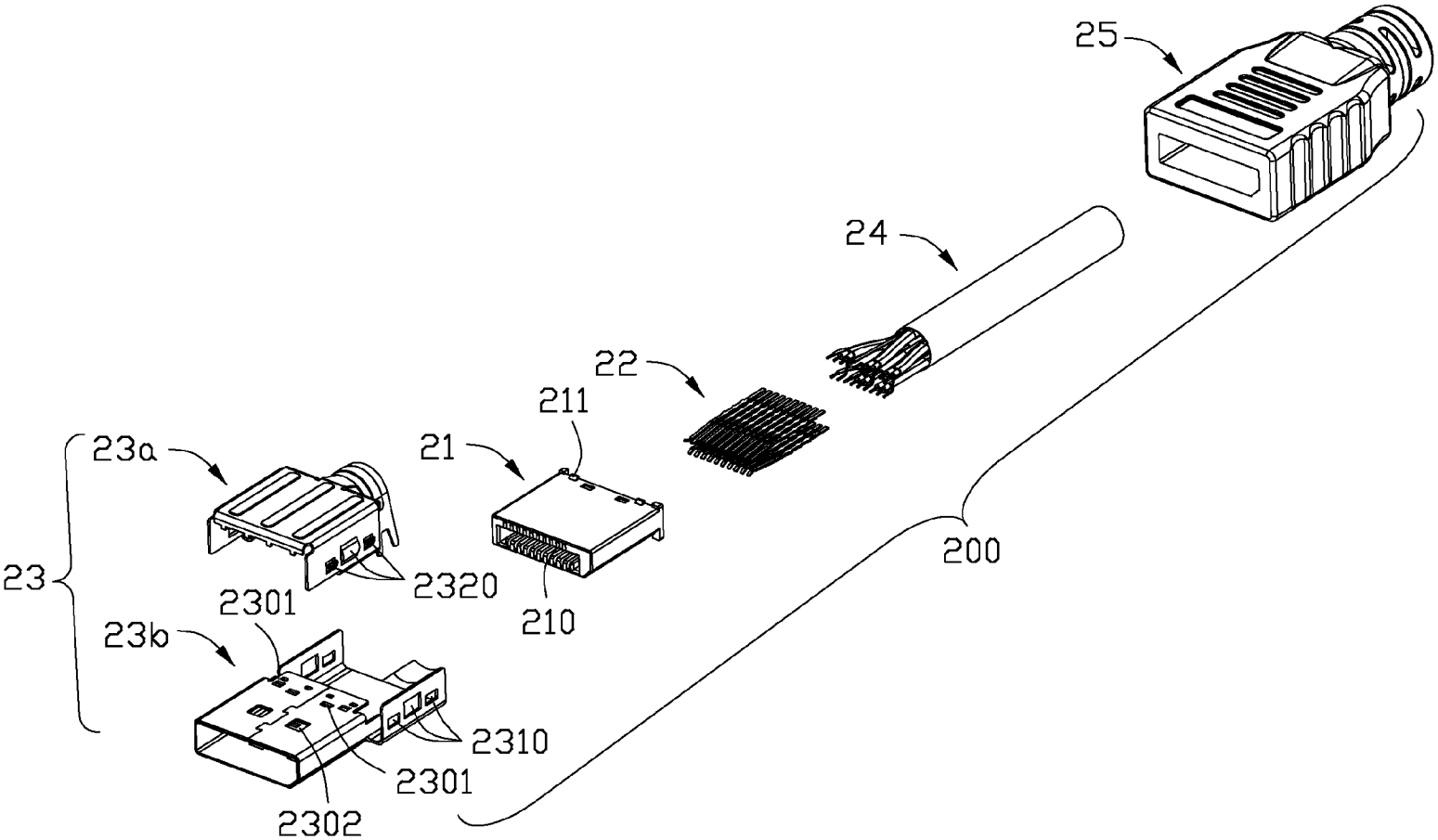
FIG. 3 is an exploded view of the electrical connector shown in FIG. 1.
Figure 4:
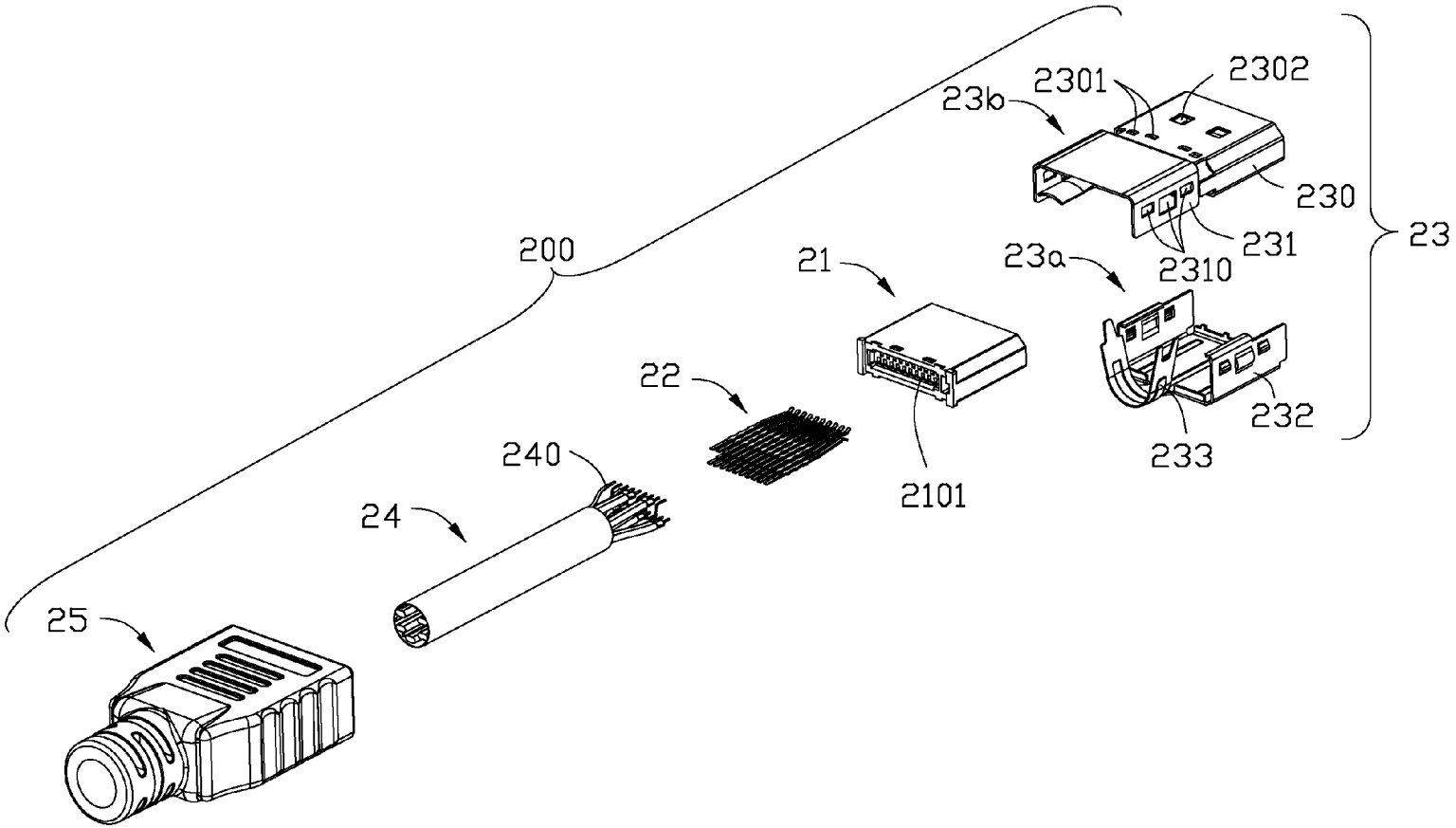
FIG. 4 is a view similar to FIG. 2, but viewed from another aspect.

Referring to FIGS. 3-4, the electrical connector 200 comprises a first insulative housing 21, a plurality of first contacts 22 assembled in the first insulative housing 21, a first metallic shell 23 shielding on the first insulative housing 21, and an insulative cover 25 over-molded on the first metallic shell 23.

Referring to FIGS. 3-4, the first insulative housing 21 include a top wall, a bottom wall and two side walls connected with the top and bottom wall. The first insulative housing 21 has a receiving space 210 formed by four walls thereof. A plurality of receiving channels 2101 are defined on interior surfaces of the top and bottom wall, and communicated with the receiving space 210. The first insulative housing 21 defines a pair of protrusions 211 on an upper surface thereof and another pair of protrusions 211 on a lower surface thereof.

Figure 5:
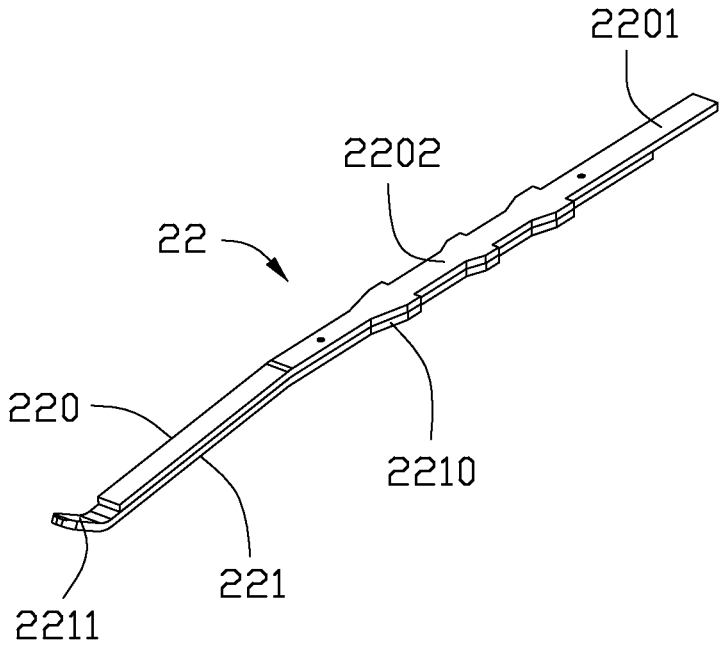
FIG. 5 is a perspective view of a contact of the electrical connector shown in FIG. 3.
Figure 6:
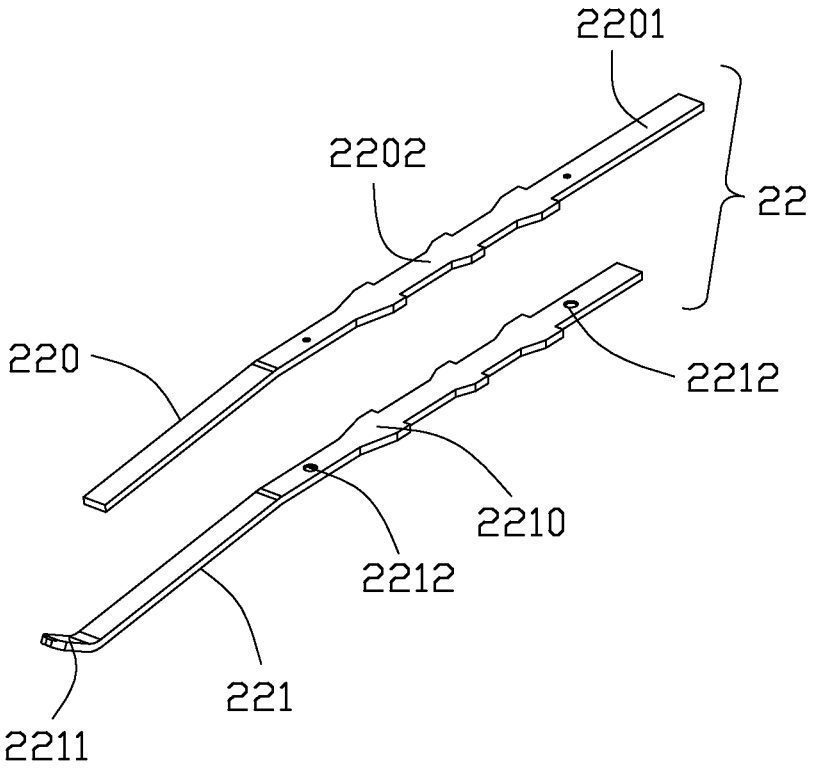
FIG. 6 is an exploded view of the contact shown in FIG. 5.
Figure 7:
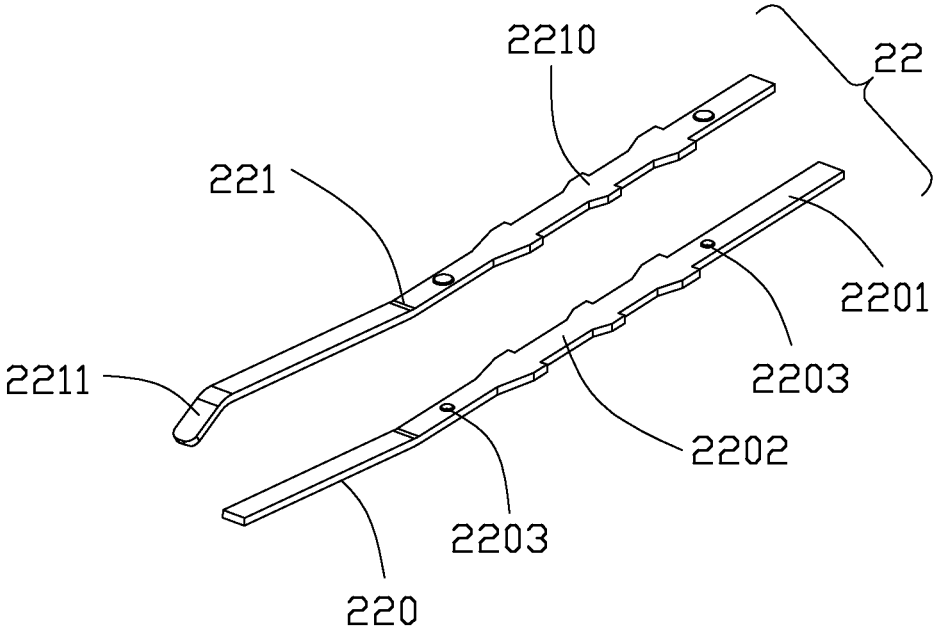
FIG. 7 is a view similar to FIG. 6, but viewed from another aspect.

Referring to FIGS. 5-7, each first contact 22 includes two sub-contacts stacked with each other, that is a first sub-contact 220 and a second sub-contact 221. The first sub-contact 220 comprises a first main section 2202 and a soldering section 2201 extending backwards from the first main section 2202. The second sub-contact 221 comprises a second main section 2210 and a curved contacting section 2211 extending forwards from the second main section 2210.

The first main section 2202 defines a plurality of tiny posts 2203 on a bottom surface thereof, and the second main section 2210 defines a number of holes 2212 in a top surface thereof for receiving the corresponding posts 2203. In other selectable embodiments, posts 2203 also can be defined on the second main section 2210 with holes 2212 defined in the first main section 2202. When the first sub-contact 220 assembled with the second sub-contact 221, firstly posts 2203 of the first sub-contact 220 are inserted into the corresponding holes 2212 of the second sub-contact 221, thus to achieve pre-orientation between the first sub-contact 220 and the second sub-contact 221. Then the first sub-contact 220 and the second sub-contact 221 are formed a firm combination between each other by Laser Welding. The first main section 2202 is superimposed on the second main section 2210 to form a main portion of the first contact 22, thus the main portion of the first contact 22 has a larger thickness than the contacting section 2211 and the soldering section 2201.

Referring to FIGS. 3-4, the metallic shell 23 includes a top shell 23*a* and a bottom shell 23*b* assembled with each other. The bottom shell 23*b* includes an enclosed frame portion 230 and a U-shaped shielding portion 231 extending backwards from the frame portion 230. The frame portion 230 defines a plurality of locking holes 2301 on a top wall and a bottom wall, and a pair of openings 2302 are defined in front of the locking holes 2301. A plurality of latching holes 2310 with different sizes are defined on both sides of the U-shaped shielding portion 231. The top shell 23*a* comprises a U-shaped shelter 232 and a crimping portion 233 extending backwards from an upper wall of the U-shaped shelter 232. The U-shaped shelter 232 defines a plurality of bumps 2320 cooperated with relative latching holes 2310.

Figure 8:
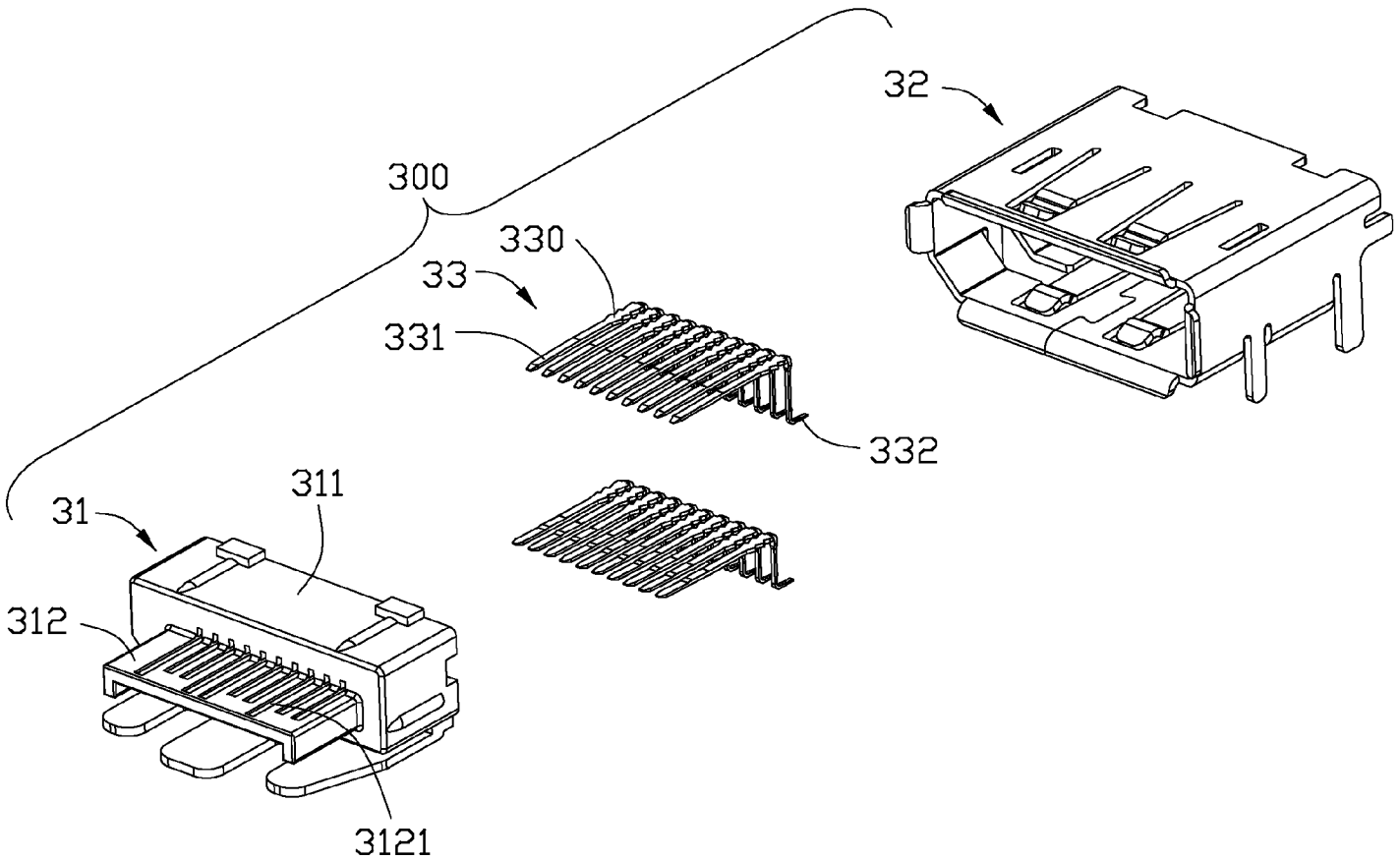
FIG. 8 is an exploded view of the complementary connector shown in FIG. 2.

Referring to FIG. 8, the complementary connector 300 comprises a second insulative housing 31, a plurality of second contacts 33 retained in the second insulative housing 31, and a second metallic shell 32 enclosing on the second insulative housing 31.

The second insulative housing 31 includes a base portion 311 and a tongue portion 312 extending forwards from the base portion 311. The tongue portion 312 is configured with a n-shaped structure, and a plurality of passages 3121 are defined on both a top surface and a bottom surface of the tongue portion 312, and extending through the base portion 311.

Each second contact 33 defines a mating section 331, a main section 330 extending from the mating section 331, and a soldering section 332 perpendicular to the main section 330. The main section 330 has an L-shaped configuration. A horizontal part of the main section 330 is retained in the corresponding passage 3121, and a vertical part is adjacent to a back end of the base portion 311. The main section 330 defines a plurality of barbs on both sides for interferentially engaging with the corresponding passage 3121.

Figure 10:
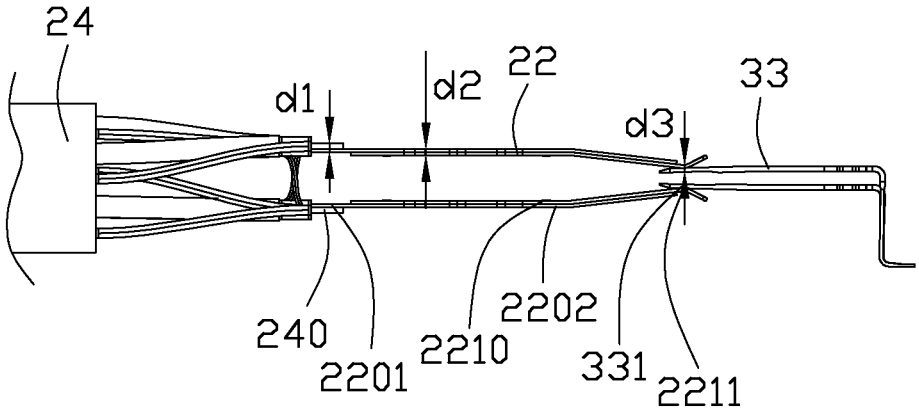
FIG. 10 is a perspective view of the contacts of the electrical connector mating with corresponding contacts of the complementary connector shown in FIG. 1.

Referring to FIGS. 1-2, and conjunction with FIGS. 9-10, when the electrical connector 200 mating with the complementary connector 300, front segment of the electrical connector 200 is inserted into the second metallic shell 32 of the complementary connector 300, the contacting sections 2211 of the first contacts 22 of the electrical connector 200 are contacting with the corresponding mating sections 331 of the second contacts 33, therefore for signal transmission. The cable 24 comprises a plurality of inner conductors 240, d1 is a total thickness of one inner conductor 240 soldered with the corresponding soldering section 2201, d2 is the thickness of the main portion of one first contact 22, d3 is a total thickness of one contacting section 2211 of one first contact 22 contacting with the corresponding mating section 331 of the second contact 33. And d1, d2, d3 have a same dimension generally.

The relationship between a characteristic impedance and a thickness of a conductor is as below:

$$Z_o = \left[120 \Big/ (Er)^{\frac{1}{2}}\right] \times [\ln(2 \times S/d)]$$

Where: $Z_o$ defines a characteristic impedance, Er is a dielectric constant, S defines a distance between two neighboring conductors, d defines a thickness of a conductor.

According to the above formula, when the parameters affecting the characteristic impedance $Z_o$, such as Er and S, can not be effectively compensated, only by adjusting the thickness of the conductor to achieve an effective compensation. When the other parameters are constant, the characteristic impedance $Z_o$ is inversely proportional to the thickness of the conductor d. When different regions of the conductor having different thickness, mutation phenomenon of the characteristic impedance of the contacts may be existed during operations, thereby affecting the stability of the transmitted signal. Therefore, when d1, d2, d3 are substantially same, it will reduce the impedance of the mutation, and improve signal transmission performance.

Each first contact 22 of the electrical connector 200 has two pieces stacked configuration, contacting section 2211 and soldering section 2201 have normal thickness, and main portion is thickened. The total thickness d1 of the cable 24 soldered with the corresponding soldering section 2201, is substantially same as the thickness d2 of the main portion of one first contact 22, and same as the total thickness d3 of one contacting section 2211 of one first contact 22 contacting with the corresponding mating section 331 of the second contact 33, therefore mutation phenomenon of the characteristic impedance of the contact may be reduced. Meanwhile, each first contact 22 is superimposed, and connected with the cable 24 by laser welding, thus material of each first contact 22 is selected with lower requirement, and the cost of the electrical connector is saving.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

a first insulative housing having a plurality of receiving channels;

a plurality of first contacts retained in corresponding receiving channels of the first insulative housing, each first contact comprising a main portion, a contacting section located in front of the base portion, and a soldering section behind the base portion; and a metallic shell shielding on the first insulative housing; wherein each first contact has a first sub-contact and a second sub-contact stacked with each other, and the first sub-contact comprises a first main section and the soldering section, the second sub-contact comprises a second main section and the contacting section, the first main section is superimposed on the second main section to form the main portion, and the main portion of the first contact has a larger thickness than the contacting section and the soldering section; wherein the first sub-contact and the second sub-contact are laser welded to each other; wherein the metallic shell includes a top shell and a bottom shell assembled with each other, and the top shell and the bottom shell comprise a plurality of cooperating bumps and latching holes; wherein an insulative cover over-molded on the metallic shell.

2. The electrical connector according to claim 1, further comprising a cable electrically connected with the first contacts, and wherein the cable comprises a plurality of wires soldered with corresponding soldering sections of the first contacts.

3. The electrical connector according to claim 1, wherein one of the first sub-contact and the second sub-contact defines a plurality of posts, and the other of the first sub-contact and the second sub-contact defines a number of holes for receiving corresponding posts.

4. An electrical connector assembly comprising:

an electrical connector connected with a cable and comprising a first insulative housing and a plurality of first contacts received in the first insulative housing, each first contact including a main portion, a contacting section in front of the main portion, and a soldering section behind the main portion, the cable including a plurality of inner conductors; and a complementary connector mating with the electrical connector and comprising a second insulative housing and a plurality of second contacts retained in the second insulative housing; wherein the main portion of each first contact is formed by two pieces stacked with each other, and the thickness of the main portion of one first contact is substantially same as a combined thickness of one inner conductor and a corresponding soldering section soldered with the one inner conductor and is same as a total thickness of the contacting section of one first contact and a corresponding mating section of the second contact in contact with the one first contact; wherein each first contact has a first sub-contact and a second sub-contact stacked with each other; wherein the first sub-contact comprises a first main section and the soldering section, the second sub-contact comprises a second main section and the contacting section, and the first main section is superimposed on the second main section to form the main portion; wherein one of the first sub-contact and the second sub-contact defines a post, and the other of the first sub-contact and the second sub-contact defines a the post; wherein the first sub-contact and the second sub-contact are formed a firm combination between each other by laser welding.

5. The electrical connector assembly as claimed in claim 4, wherein the main portion of each first contact has a larger thickness than the contacting section and the soldering section.

6. An electrical connector assembly comprising:

an electrical connector including an insulative housing with a plurality of contacts disposed therein, each of said contacts formed from sheet metal via stamping and forming, and extending along a front-to-back direction and essentially including two elongated pieces tightly stacked with each other in a vertical direction perpendicular to said front-to-back direction, each of said contacts defining a front contacting section, a rear tail sections and a main section therebetween along said front-to-back direction; wherein each of said contacts essentially keeps a same density along the front-to-back direction and defines a first thickness on the main section and a second thickness on either the contacting section or the tail section, said first thickness being generally twice with regard to the second thickness; wherein one of said two elongated pieces forms the contacting section and a part of said main section, and the other of said two elongated pieces forms the tail section and another part of said main section; wherein one of said two pieces defines a post, and the other of said two pieces defines a hole for receiving the post; wherein said two pieces form a firm combination by laser welding.

7. The electrical connector assembly as claimed in claim 6, wherein the front contacting section and the rear tail section are formed by said two elongated pieces, respectively.

8. The electrical connector assembly as claimed in claim 6, wherein said two pieces are discrete from each other without unitary joint therebetween at a lateral side edges but in a tightly stacked manner in the vertical direction.

9. The electrical connector assembly as claimed in claim 6, wherein the main section forms barbs for retention.

10. The electrical connector assembly as claimed in claim 6, wherein said connector is a plug connector equipped with a cable having wires mechanically and electrically connected to the tail sections of the corresponding contacts, respectively.

11. The electrical connector assembly as claimed in claim 6, further including another connector with terminals mechanically and electrically connected to the contacting sections of the contacts, respectively.

12. The electrical connector assembly as claimed in claim 11, wherein said connector is a plug connector equipped with a cable, and said another connector is a receptacle connector for mounted to a printed circuit board.

13. The electrical connector assembly as claimed in claim 6, wherein one of said two pieces forms a post to be inserted into a hole formed in the other of said two pieces.

* * * * *